US006565415B1

(12) United States Patent
Christiansen et al.

(10) Patent No.: US 6,565,415 B1
(45) Date of Patent: May 20, 2003

(54) METHOD AND APPARATUS OF ENGRAVING A THREE DIMENSIONAL IMAGE ON METAL

(75) Inventors: Michael D. Christiansen, Yorba Linda, CA (US); Robert W. Clausen, Temecula, CA (US)

(73) Assignee: Pacific Crest Industries, Lake Elsinore, CA (US)

( * ) Notice: Subject to any disclaimer, the term of this patent is extended or adjusted under 35 U.S.C. 154(b) by 0 days.

(21) Appl. No.: 09/919,044

(22) Filed: Jul. 30, 2001

(51) Int. Cl.[7] ..... B24B 1/00
(52) U.S. Cl. ..... 451/5; 451/59; 451/359
(58) Field of Search ..... 451/9, 29, 59, 451/5, 344, 352, 353, 358, 359, 10

(56) References Cited

U.S. PATENT DOCUMENTS

| | | | | |
|---|---|---|---|---|
| 173,783 A | | 2/1876 | Hayes | |
| 366,286 A | | 7/1887 | Wood | |
| 369,147 A | | 8/1887 | Wood | |
| 4,655,981 A | | 4/1987 | Nielsen et al. | |
| 5,370,165 A | * | 12/1994 | Stornetta | 144/144 R |
| 5,568,391 A | | 10/1996 | McKee | |
| 5,944,587 A | * | 8/1999 | Stadtfeld | 451/59 |
| 6,003,228 A | | 12/1999 | Riggio | |
| 6,021,417 A | | 2/2000 | Massarsky | |
| 6,280,309 B1 | * | 8/2001 | Van Osenbruggen | 451/415 |
| 6,287,177 B1 | * | 9/2001 | Shaffer | 451/59 |

* cited by examiner

*Primary Examiner*—Eileen P. Morgan
(74) *Attorney, Agent, or Firm*—Thomas I. Rozsa; Tony D. Chen

(57) ABSTRACT

A method and apparatus of engraving three-dimensional images onto metal or the like and creating unique graphic images which are unique images created by engraving the images into architectural metal such as steel, aluminum, brass, copper, etc. The method and apparatus comprise a computer numerical control (CNC) router which can rotate at speeds of approximately in a range of 4,000 RPM to 6,000 RPM, a bristle disc installed into the CNC router and a pressure mechanism for applying sufficient pressure on the bristle disc so that rubber bristles are caused to be embedded approximately 0.060 inch into a metal surface as the CNC router causes a three-dimensional image to be engraved into the metal surface.

43 Claims, 3 Drawing Sheets

FIG.2
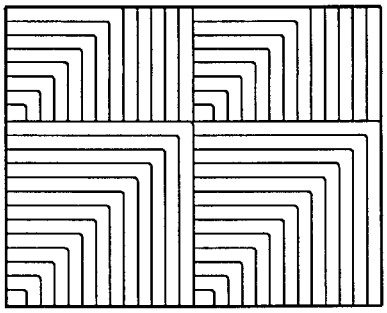
Egyption Tile
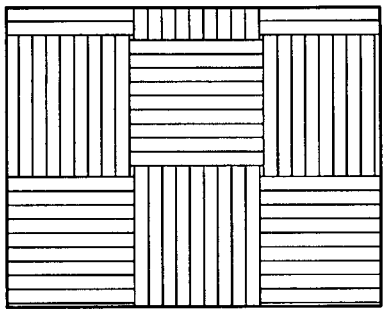
Basketweave
FIG.3
FIG.4
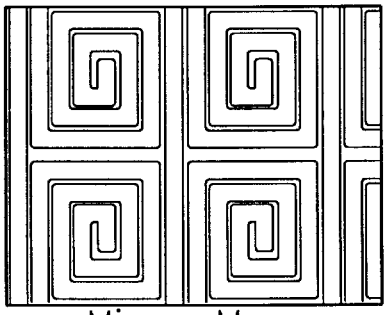
Mirror Maze
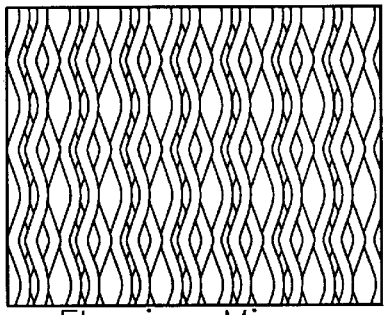
Flaming Mirror
FIG.5
FIG.6
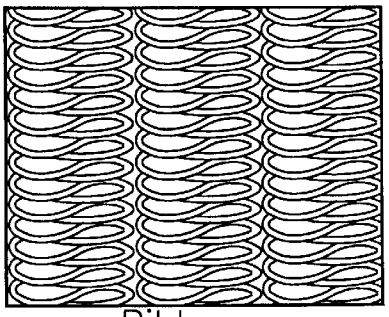
Ribbons
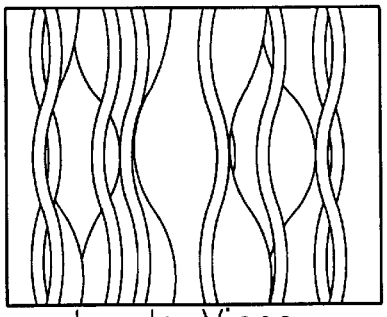
Jungle Vines
FIG.7
FIG.8
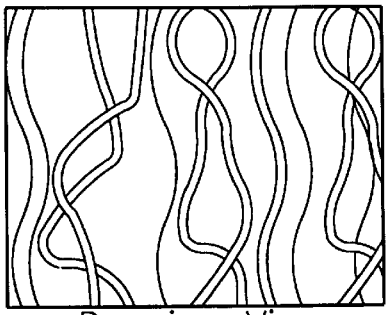
Dancing Vines
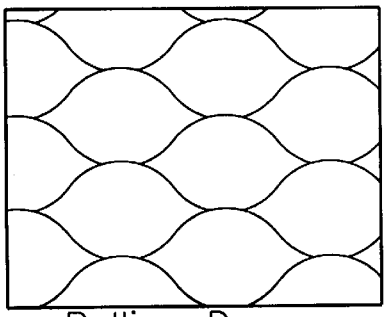
Rolling Dunes
FIG.9

FIG.10
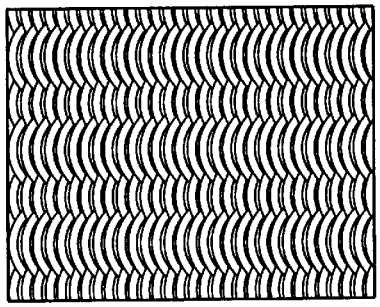
Shimmering Cascade
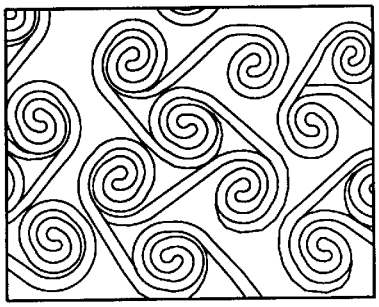
Twisters
FIG.11
FIG.12
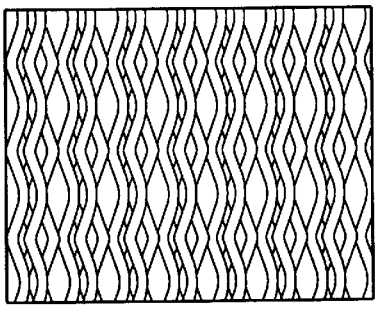
Braided Tubes
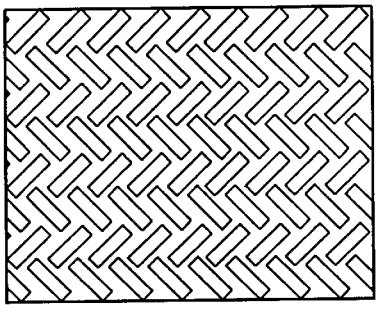
HerringBone
FIG.13
FIG.14
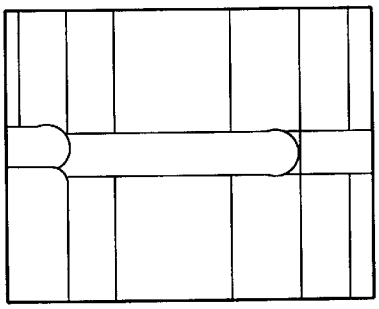
Vegas Clouds
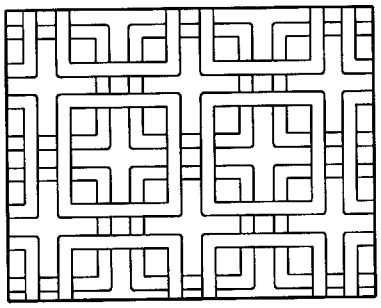
Square Reflections
FIG.15
FIG.16
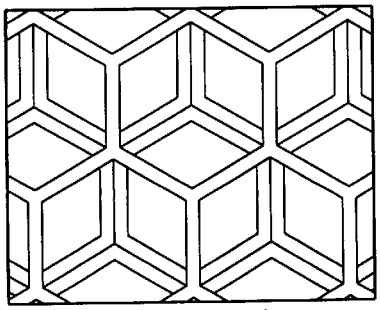
Cubic Illusion
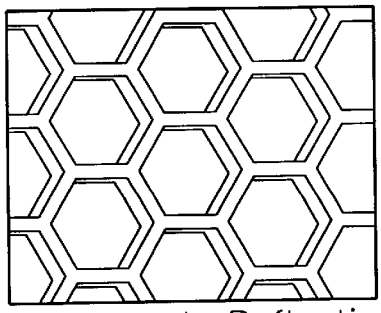
Honeycomb Reflection
FIG.17

METHOD AND APPARATUS OF ENGRAVING A THREE DIMENSIONAL IMAGE ON METAL

BACKGROUND OF THE INVENTION

1. Field of the Invention

The present invention relates generally to the field of engraving. More particularly, the present invention relates to a method of engraving three dimensional images onto metal.

2. Description of the Prior Art

Specifically, there are currently no prior art references which teach a method of engraving three-dimensional images onto metal, such as steel, aluminum, brass, copper, etc.

The following nine (9) prior art patents are found to be pertinent to the field of the present invention:

1. U.S. Pat. No. 173,783 issued to Hayes on Feb. 22, 1876 for "Sheet-Metal Plates For Shutters, Etc." (hereafter the "Hayes");
2. U.S. Pat. No. 366,286 issued to Wood on Jul. 12, 1887 for "Ornamentation Of Sheet Metal" (hereafter the "Wood '286");
3. U.S. Pat. No. 369,147 issued to Wood on Aug. 30, 1887 for "Ornamented Sheet Metal" (hereafter the "Wood '147");
4. U.S. Pat. No. 566,489 issued to Wilmot on Aug. 25, 1896 for "Metal Tiling" (hereafter the "Wilmot");
5. U.S. Pat. No. 4,655,981 issued to Nielsen et al. on Apr. 7, 1987 for "Method Of Producing A Plate With A Decorative Pattern In its Surface" (hereafter the "Nielsen");
6. U.S. Pat. No. 5,568,391 issued to Mckee on Oct. 22, 1996 for "Automated Tile Mosaic Creation System" (hereafter the "Mckee");
7. U.S. Pat. No. 5,944,587 issued to Stadtfeld on Aug. 31, 1999 for "Cutting Edge Rounding Method" (hereafter the "Stadtfeld");
8. U.S. Pat. No. 6,003,228 issued to Riggio on Dec. 21, 1999 for "Method For Making A Decorative Or Jewelry Item" (hereafter the "Riggio"); and
9. U.S. Pat. No. 6,021,417 issued to Massarksy on Feb. 1, 2000 for "Method Of Stimulating The Creation Of An Artist's Drawing Or Painting, And Device For Accomplishing Same" (hereafter the "Massarksy").

Hayes discloses an improvement in sheet-metal plates for shutters. The improvement comprises a metal plate, where punctures and indents are throughout the whole or part of the surface without regard to any particular number or spacing or position of the punctures or indentations. The punctures are a V-shaped configuration.

Wood '286 discloses an ornamentation of sheet metal with raised portions which are formed of bosses.

Wood '147 discloses an ornamented sheet metal with the surface impressed with a pattern resembling leather having a rough surface.

Wilmot discloses a metal tiling.

Nielsen discloses a method of producing a plate with a decorative pattern in its surface. The method forms a decorative pattern on a surface of a layer of material in a soft, plastic condition. The method comprises whipping the layer surface by the free end portions of a plurality of flexible thread-like or string-like members so as to make depressions therein.

Mckee discloses an automated tile mosaic creation system which creates tile mosaics for architectural decorative surfaces.

Stadtfeld discloses a cutting edge rounding method for treating a cutting edge of a tool to reduce deterioration of the cutting edge during a subsequent machining operation.

Riggio discloses a method for making a decorative or jewelry item. The images are converted to a computer numeric control dataset for controlling the milling machine, which cuts the first contour into the underside of a cabochon of stone or crystal and the second contour into a die stamp tool.

Massarksy discloses a method of stimulating the creation of an artist's drawing or painting, and device for accomplishing same.

While many of the above cited references have described various methods and systems for creating decorative patterns, there is a need for providing a simple and reliable method and apparatus of creating various unique graphic picture designs on architectural metals which are engraved into architectural metals such as steel, aluminum, etc.

SUMMARY OF THE INVENTION

The present invention is a novel and unique method and apparatus of engraving three-dimensional images onto metal or the like.

The present invention creates unique graphic pictures which are unique designs created by engraving the designs into architectural metal such as steel, aluminum, brass, copper, etc. The method comprises the steps of:

1. providing a computer numerical control (CNC) router which is specifically designed to rotate at speeds of approximately in a range of 4,000 RPM to 6,000 RPM;
2. installing a bristle disc into the CNC router and having rubber bristles which contain a special aggregate; and
3. applying sufficient pressure on the bristle disc so that the rubber bristles are caused to be embedded approximately 0.060 inches into a metal surface as the CNC router is causing a three-dimensional image to be ground into the metal surface.

The diameter of the bristle disc can have a range of approximately ⅛ inch to 7 inches in diameter. The RPM speeds are the reverse so that for a ⅛ inch disc, the speed of 6,000 RPM would be used, and for a 7" disc, the speed of 4,000 RPM would be used, and there is a linear variation between the increase in the size of the disc and the decrease in the RPM with which the disc is operated.

The concept is to have a flat table onto which the metal is placed and then the CNC router is placed above the metal with the bristle disc on the router in the manner described above, and then a preselected computer program is incorporated to cause the disc to run the patterns to create the specific unique three-dimensional design. Through the method of the present invention, very beautiful designs are created onto metal surfaces.

It has been discovered, according to the present invention, that by using a computer numerical control (CNC) router which can rotate at speeds of approximately in a range of 4,000 RPM to 6,000 RPM, then three-dimensional images are produced onto metal. This range of RPM is important because if the speed is above 6,000 RPM, the three-dimensional image comes out as a flat picture and it loses the 3D effect. If the router rotates below 4,000 RPM, it is not economic to do the work and further, the slow speed does not also create the desired visual effect.

It has further been discovered, according to the present invention, that by utilizing a bristle disc which contains rubber bristles which contain a special aggregate, and then applying sufficient pressure on the bristle disc so that the rubber bristles are caused to be embedded approximately 0.060 inches into a surface of a metal as the router is causing the three-dimensional image to be ground into the metal. If there is less pressure on the disc, the extended depth is less than 0.060 inch, and then there is not enough metal removed to create the visual three-dimensional image. If the pressure on the disc exceeds 0.060 inch, then there will be too much metal being removed causing it to overheat and the metal will warp.

It is an object of the present invention to provide a method of engraving three-dimensional images onto metal or the like so that unique designs are created into architectural metal such as steel, aluminum, brass, copper, etc.

It is also an object of the present invention to provide a method utilizing a computer numerical control (CNC) router which is specifically designed to rotate at speeds of approximately in a range of 4,000 to 6,000 RPM for engraving the three-dimensional images.

It is an additional object of the present invention to provide a bristle disc which contains rubber bristles that contain a special aggregate to be used with a CNC router.

It is a further object of the present invention to provide a sufficient pressure on the bristle disc so that the rubber bristles are caused to be embedded approximately 0.060 inch into a metal surface as the router is causing the three-dimensional image to be ground into the metal surface.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 2 is an illustrative view of an egyptian tile image made according to the method of the present invention;

FIG. 3 is an illustrative view of a basketweave image made according to the method of the present invention;

FIG. 4 is an illustrative view of a mirror maze image made according to the method of the present invention;

FIG. 5 is an illustrative view of a flaming mirror image made according to the method of the present invention;

FIG. 6 is an illustrative view of ribbon images made according to the method of the present invention;

FIG. 7 is an illustrative view of jungle vines images made according to the method of the present invention;

FIG. 8 is an illustrative view of dancing vine images made according to the method of the present invention;

FIG. 9 is an illustrative view of rolling dune images made according to the method of the present invention;

FIG. 10 is an illustrative view of a shimmering cascade image made according to the method of the present invention;

FIG. 11 is an illustrative view of twister images made according to the method of the present invention;

FIG. 12 is an illustrative view of braided tube images made according to the method of the present invention;

FIG. 13 is an illustrative view of a herringbone image made according to the method of the present invention;

FIG. 14 is an illustrative view of vegas cloud images made according to the method of the present invention;

FIG. 15 is an illustrative view of square reflection images made according to the method of the present invention;

FIG. 16 is an illustrative view of a cubic illusion image made according to the method of the present invention; and FIG. 17 is an illustrative view of a honeycomb reflection image made according to the method of the present invention.

DETAILED DESCRIPTION OF THE PREFERRED EMBODIMENTS

Figure 1:
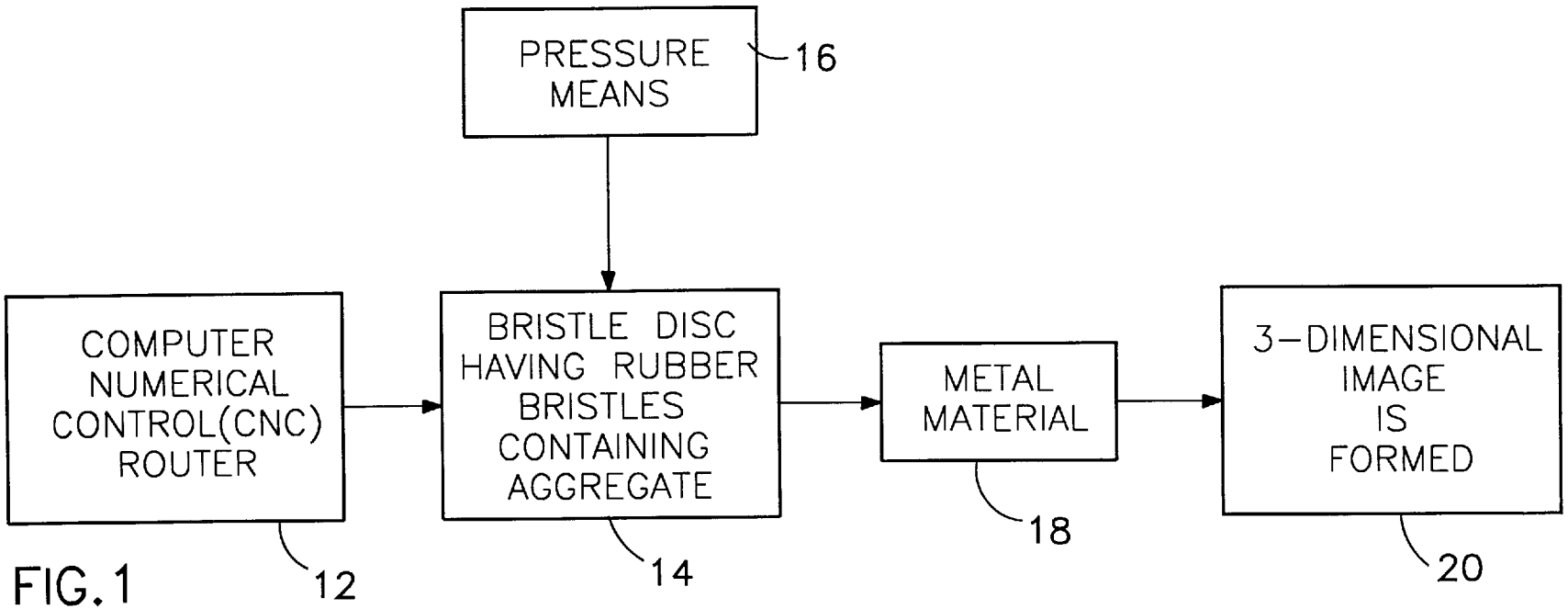
FIG. 1 is a simplified block diagram of an apparatus in accordance with the present invention.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIG. 1, there is shown at 10 a method and apparatus of engraving three-dimensional images onto metal or the like. The method and apparatus 10 of the present invention create unique graphic images which are unique images created by engraving the images into architectural metal such as steel, aluminum, brass, copper, etc. The method and apparatus comprise a computer numerical control (CNC) router 12 which is specifically designed to rotate at speeds of approximately in a range of 4,000 RPM to 6,000 RPM. The CNC router 12 is provided with a bristle disc 14 which is installed thereto. The bristle disc 14 has rubber bristles which contain a special aggregate. Pressure means 16 applies sufficient pressure on the bristle disc 14 so that the rubber bristles are caused to be embedded approximately 0.060 inch into a metal surface 18 as the CNC router 12 causes a three-dimensional image 20 to be ground into the metal surface 18.

The diameter of the bristle disc 12 can have a range of approximately ⅛ inch to 7 inches in diameter. The RPM speeds are the reverse so that for a ⅛" disc, the speed of 6,000 RPM would be used, and for a 7" disc, the speed of 4,000 RPM would be used, and there is a linear variation between the increase in the size of the bristle disc 12 and the decrease in the RPM with which the bristle disc 12 is operated. The preferred type of bristle disc 12 for use with the present invention, are bristle disks manufactured by the 3M Corporation. The bristle disks are described in detail in the 3M™ Bristle Disks Precision-engineered 3-D abrasives for safer operation, fast cut and consistent finishes information flyer, a copy of which is attached as Exhibit "1" to this patent. Specifically, the preferred bristle discs manufactured by 3M Corporation contain a Cubitron™ mineral in them to help with the abrasive action.

The method and apparatus 10 can be used with a flat table onto which the metal 18 is placed and then the CNC router 12 is placed above the metal 18 with the bristle disc 14 on the router 14 in the manner described above, and then a preselected computer program is incorporated to cause the bristle disc 14 to run the patterns to create the specific unique three-dimensional image 20. Through the method and apparatus of the present invention, very beautiful images are created onto metal surfaces.

Referring to FIGS. 2 through 16, there are illustrative views of the images that can be created by the present invention method and apparatus. FIGS. 2 through 16 respectively show an egyptian tile image, a basketweave image, a mirror maze image, a flaming mirror image, ribbon images, jungle vines images, dancing vine images, rolling dune images, a shimmering cascade image, twister images, braided tube images, a herringbone image, vegas cloud images, square reflection images, a cubic illusion image, and a honeycomb reflection image. It will be appreciated that the images created by the present invention is not limited to the images shown in FIGS. 2 through 16. It is emphasized that while the images in FIGS. 2 through 16 are preferred, it is also within the spirit and scope of the present invention to create other images not shown.

Defined in detail, the present invention is a method of engraving a three-dimensional image onto a metal surface, the method comprising the steps of: (a) providing a computer numerical control (CNC) router having a rotation speed of approximately 4,000 RPM to 6,000 RPM; (b) providing a bristle disc having rubber bristles which contain a special aggregate; (c) installing the bristle disc onto the CNC router; and (d) applying sufficient pressure on the bristle disc so that the rubber bristles are caused to be embedded approximately 0.060 inch into the metal surface as the CNC router causes the three-dimensional image to be engraved into the metal surface.

Defined broadly, the present invention is a method of engraving a three-dimensional image onto a metal surface, the method comprising the steps of: (a) providing a computer numerical control (CNC) router having a rotation speed of approximately 4,000 RPM to 6,000 RPM; (b) installing a bristle disc onto the CNC router and having rubber bristles which contain a special aggregate; and (c) applying sufficient pressure on the bristle disc so that the rubber bristles are caused to be embedded approximately 0.060 inch into the metal surface as the CNC router causes the three-dimensional image to be engraved into the metal surface.

Defined more broadly, the present invention is a method of producing an image onto metal, the method comprising the steps of: (a) providing a computer numerical control (CNC) router; (b) installing a bristle disc onto the CNC router and having bristles; and (c) applying pressure on the bristle disc so that the bristles on the bristle disc are caused to be embedded into the metal as the CNC router causes the image to be grounded into the metal.

Further defined in detail, the present invention is an apparatus for engraving a three-dimensional image onto a metal surface, comprising: (a) a computer numerical control (CNC) router having a rotation speed of approximately 4,000 RPM to 6,000 RPM; (b) a bristle disc having rubber bristles which contain a special aggregate, the bristle installed into the CNC router; and (c) pressure means for applying sufficient pressure on the bristle disc so that the rubber bristles are caused to be embedded approximately 0.060 inch into the metal surface as the CNC router causes the three-dimensional image to be engraved into the metal surface.

Further defined broadly, the present invention is a apparatus for engraving a three-dimensional image onto a metal surface, comprising: (a) a computer numerical control (CNC) router having a rotation speed of approximately 4,000 RPM to 6,000 RPM; (b) a bristle disc having bristles and installed into the CNC router; and (c) means for applying sufficient pressure on the bristle disc so that the bristles are caused to be embedded approximately 0.060 inch into the metal surface as the CNC router causes the three-dimensional image to be engraved into the metal surface.

Further defined more broadly, the present invention is an apparatus of producing an image onto metal, the apparatus comprising the steps of: (a) a computer numerical control (CNC) router; (b) a bristle disc having bristles and installed into the CNC router; and (c) means for applying pressure on the bristle disc so that the bristles on the bristle disc are caused to be embedded into the metal as the CNC router causes the image to be grounded into the metal.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A method of engraving a three-dimensional image onto a metal surface, the method comprising the steps of:

a. providing a computer numerical control (CNC) router having a rotation speed of approximately 4,000 RPM to 6,000 RPM;

b. providing a bristle disc having rubber bristles which contain a special aggregate;

c. installing said bristle disc onto said CNC router; and d. applying sufficient pressure on said bristle disc so that said rubber bristles are caused to be embedded approximately 0.060 inch into said metal surface as said CNC router causes said three-dimensional image to be engraved into said metal surface.

2. The method in accordance with claim 1, wherein said special aggregate includes a Cubitron™ material which is contained in bristle disks manufactured by 3M Corporation.

3. The method in accordance with claim 1, wherein the diameter of said bristle disc includes a range of approximately ⅛ inch to 7 inches.

4. The method in accordance with claim 3, wherein the 6,000 RPM is used with the ⅛ inch diameter of said bristle disc.

5. The method in accordance with claim 3, wherein the 4,000 RPM is used with the 7 inch diameter of said bristle disc.

6. The method in accordance with claim 1, wherein the speed of said bristle disc has a linear variation between the increase in diameter of said bristle disc and the decrease in the RPM with which said bristle disc is operated.

7. A method of engraving a three-dimensional image onto a metal surface, the method comprising the steps of:

a. providing a computer numerical control (CNC) router having a rotation speed of approximately 4,000 RPM to 6,000 RPM;

b. installing a bristle disc onto said CNC router and having rubber bristles which contain a special aggregate; and c. applying sufficient pressure on said bristle disc so that said rubber bristles are caused to be embedded approximately 0.060 inch into said metal surface as said CNC router causes said three-dimensional image to be engraved into said metal surface.

8. The method in accordance with claim 7, wherein said special aggregate includes a Cubitron™ material which is contained in bristle disks manufactured by 3M Corporation.

9. The method in accordance with claim 7, wherein the diameter of said bristle disc includes a range of approximately ⅛ inch to 7 inches.

10. The method in accordance with claim 9, wherein the 6,000 RPM is used with the ⅛ inch diameter of said bristle disc.

11. The method in accordance with claim 9, wherein the 4,000 RPM is used with the 7 inch diameter of said bristle disc.

12. The method in accordance with claim 7, wherein the speed of said bristle disc has a linear variation between the increase in diameter of said bristle disc and the decrease in the RPM with which said bristle disc is operated.

13. A method of producing an image onto metal, the method comprising the steps of:

a. providing a computer numerical control (CNC) router;

b. installing a bristle disc onto said CNC router and having bristles; and c. applying pressure on said bristle disc so that said bristles on said bristle disc are caused to be embedded approximately 0.060 inch into said metal as said CNC router causes the image to be grounded into said metal.

14. The method in accordance with claim 13, further comprising the step of applying a special aggregate onto said bristles of said bristle disc.

15. The method in accordance with claim 13, wherein said bristles are made of rubber material.

16. The method in accordance with claim 13, wherein the diameter of said bristle disc includes a range of approximately ⅛ inch to 7 inches.

17. The method in accordance with claim 13, wherein said CNC router has a rotation speed of approximately between 4,000 RPM to 6,000 RPM.

18. The method in accordance with claim 17, wherein the 6,000 RPM is used with the ⅛ inch diameter of said bristle disc.

19. The method in accordance with claim 17, wherein the 4,000 RPM is used with the 7 inch diameter of said bristle disc.

20. The method in accordance with claim 17, wherein the speed of said bristle disc has a linear variation between the increase in diameter of said bristle disc and the decrease in the RPM with which said bristle disc is operated.

21. An apparatus for engraving a three-dimensional image onto a metal surface, comprising:

a. a computer numerical control (CNC) router having a rotation speed of approximately 4,000 RPM to 6,000 RPM;

b. a bristle disc having rubber bristles which contain a special aggregate, the bristle installed into said CNC router; and c. pressure means for applying sufficient pressure on said bristle disc so that said rubber bristles are caused to be embedded approximately 0.060 inch into said metal surface as said CNC router causes said three-dimensional image to be engraved into said metal surface.

22. The method in accordance with claim 21, wherein said special aggregate includes a Cubitron™ material which is contained in bristle disks manufactured by 3M Corporation.

23. The method in accordance with claim 21, wherein the diameter of said bristle disc includes a range of approximately ⅛ inch to 7 inches.

24. The apparatus in accordance with claim 23, wherein the 6,000 RPM is used with the ⅛ inch diameter of said bristle disc.

25. The apparatus in accordance with claim 23, wherein the 4,000 RPM is used with the 7 inch diameter of said bristle disc.

26. The apparatus in accordance with claim 21, wherein the speed of said bristle disc has a linear variation between the increase in diameter of said bristle disc and the decrease in the RPM with which said bristle disc is operated.

27. An apparatus for engraving a three-dimensional image onto a metal surface, comprising:

a. a computer numerical control (CNC) router having a rotation speed of approximately 4,000 RPM to 6,000 RPM;

b. a bristle disc having bristles and installed into said CNC router; and c. means for applying sufficient pressure on said bristle disc so that said bristles are caused to be embedded approximately 0.060 inch into said metal surface as said CNC router causes said three-dimensional image to be engraved into said metal surface.

28. The apparatus in accordance with claim 27, wherein said bristles of said bristle disc is made of rubber.

29. The apparatus in accordance with claim 27, wherein said bristles of said bristle disc contain special aggregate.

30. The apparatus in accordance with claim 29, wherein said special aggregate includes a Cubitron™ material which is contained in bristle disks manufactured by 3M Corporation.

31. The apparatus in accordance with claim 27, wherein the diameter of said bristle disc includes a range of approximately ⅛ inch to 7 inches.

32. The apparatus in accordance with claim 31, wherein the 6,000 RPM is used with the ⅛ inch diameter of said bristle disc.

33. The apparatus in accordance with claim 31, wherein the 4,000 RPM is used with the 7 inch diameter of said bristle disc.

34. The apparatus in accordance with claim 27, wherein the speed of said bristle disc has a linear variation between the increase in diameter of said bristle disc and the decrease in the RPM with which said bristle disc is operated.

35. A apparatus of producing an image onto metal, the apparatus comprising the steps of:

a. a computer numerical control (CNC) router;

b. a bristle disc having bristles and installed into said CNC router; and c. means for applying pressure on said bristle disc so that said bristles on said bristle disc are caused to be embedded approximately 0.060 inch into said metal as said CNC router causes the image to be grounded into said metal.

36. The apparatus in accordance with claim 35, wherein said bristles of said bristle disc is made of rubber.

37. The apparatus in accordance with claim 35, wherein said bristles of said bristle disc contain special aggregate.

38. The apparatus in accordance with claim 37, wherein said special aggregate includes a Cubitron™ material which is contained in bristle disks manufactured by 3M Corporation.

39. The apparatus in accordance with claim 35, wherein the diameter of said bristle disc includes a range of approximately ⅛ inch to 7 inches.

40. The apparatus in accordance with claim 35, wherein said CNC router has a rotation speed of approximately between 4,000 RPM to 6,000 RPM.

41. The apparatus in accordance with claim 40, wherein the 6,000 RPM is used with the ⅛ inch diameter of said bristle disc.

42. The apparatus in accordance with claim 40, wherein the 4,000 RPM is used with the 7 inch diameter of said bristle disc.

43. The apparatus in accordance with claim 40, wherein the speed of said bristle disc has a linear variation between the increase in diameter of said bristle disc and the decrease in the RPM with which said bristle disc is operated.

* * * * *